US009403657B2

(12) United States Patent
Fishbeck

(10) Patent No.: US 9,403,657 B2
(45) Date of Patent: Aug. 2, 2016

(54) ANGULAR WINDING

(71) Applicant: Precision, Inc., Minneapolis, MN (US)

(72) Inventor: Bruce D. Fishbeck, Minneapolis, MN (US)

(73) Assignee: Precision, Inc., Minneapolis, MN (US)

( * ) Notice: Subject to any disclaimer, the term of this patent is extended or adjusted under 35 U.S.C. 154(b) by 233 days.

(21) Appl. No.: 14/324,983

(22) Filed: Jul. 7, 2014

(65) Prior Publication Data

US 2016/0002003 A1 Jan. 7, 2016

(51) Int. Cl.

| | |
|---|---|
| ***B65H 81/08*** | (2006.01) |
| ***B65H 59/38*** | (2006.01) |
| ***H01F 41/06*** | (2016.01) |

(52) U.S. Cl.

CPC ..... *B65H 59/387* (2013.01); *B65H 81/08* (2013.01); *H01F 41/06* (2013.01); *B65H 2701/36* (2013.01)

(58) Field of Classification Search

CPC ..... B65H 81/08

See application file for complete search history.

(56) References Cited

U.S. PATENT DOCUMENTS

| | | | | |
|---|---|---|---|---|
| 3,303,010 | A * | 2/1967 | Copenhefer | B29C 47/0033 156/171 |
| 4,884,759 | A | 12/1989 | Nelle et al. | |
| 5,544,827 | A | 8/1996 | Yano | |
| 6,161,032 | A | 12/2000 | Acker | |
| 6,254,027 | B1 | 7/2001 | Kunou | |
| 6,622,954 | B2 | 9/2003 | Komuro et al. | |
| 6,978,962 | B1 | 12/2005 | Fore, Sr. et al. | |
| 7,258,296 | B2 | 8/2007 | Smith et al. | |
| 7,626,478 | B2 | 12/2009 | Kawai | |
| 2001/0056232 | A1 | 12/2001 | Lardo et al. | |
| 2003/0163171 | A1 | 8/2003 | Kast et al. | |
| 2007/0049846 | A1 | 3/2007 | Bown et al. | |
| 2007/0219618 | A1 | 9/2007 | Cully et al. | |
| 2008/0004598 | A1 | 1/2008 | Gilbert | |
| 2008/0251073 | A1 | 10/2008 | Jassell et al. | |
| 2009/0083968 | A1 | 4/2009 | Meinke | |
| 2009/0085710 | A1 | 4/2009 | Meinke | |
| 2009/0251271 | A1 | 10/2009 | Stelzer et al. | |
| 2009/0314418 | A1 | 12/2009 | Uozumi et al. | |
| 2010/0193065 | A1 | 8/2010 | Dye et al. | |
| 2010/0210939 | A1 | 8/2010 | Hartmann et al. | |

OTHER PUBLICATIONS

Zhang, et al. "A Multielement RF Coil for MRI Guidance of Interventional Devices", Journal of Magnetic Resonance Imaging 14:56-62 (2001).

* cited by examiner

*Primary Examiner* — Jeff Aftergut

(74) *Attorney, Agent, or Firm* — Brooks, Cameron & Huebsch, PLLC

(57) ABSTRACT

A method for winding can include dereeling a wire from a dereeler onto an object. The method can include rotating the object to wind the wire on the object at an angle offset from perpendicular to a longitudinal axis of the object. The method can include an axis of rotation of the rotating object that is non-collinear with the longitudinal axis of the object. The method can include a winding point on the object that remains orthogonally stationary with respect to the axis of rotation.

20 Claims, 4 Drawing Sheets

ANGULAR WINDING

BACKGROUND

Winding devices are widely used and may include a diverse assortment of implementations and applications. For example, a reel of string, wire, and/or a filament can be dereeled and wound and/or turned onto a cylindrical object (e.g., a rod, a tube, a mandrel). The filament can be wound onto the cylindrical object perpendicular to a longitudinal axis of the cylindrical object. The filament can be wound by winding the filament around the cylindrical object. The winding can be performed under varying degrees of tension. High tension during winding can result in higher rigidity and strength whereas low tension can result in more flexibility. A filament can be wound onto a cylindrical object in multiple layers. For example, a first layer can be wound across the cylindrical object from left to right and then a second layer can be wound from right to left over the first layer.

DETAILED DESCRIPTION

Figure 1:
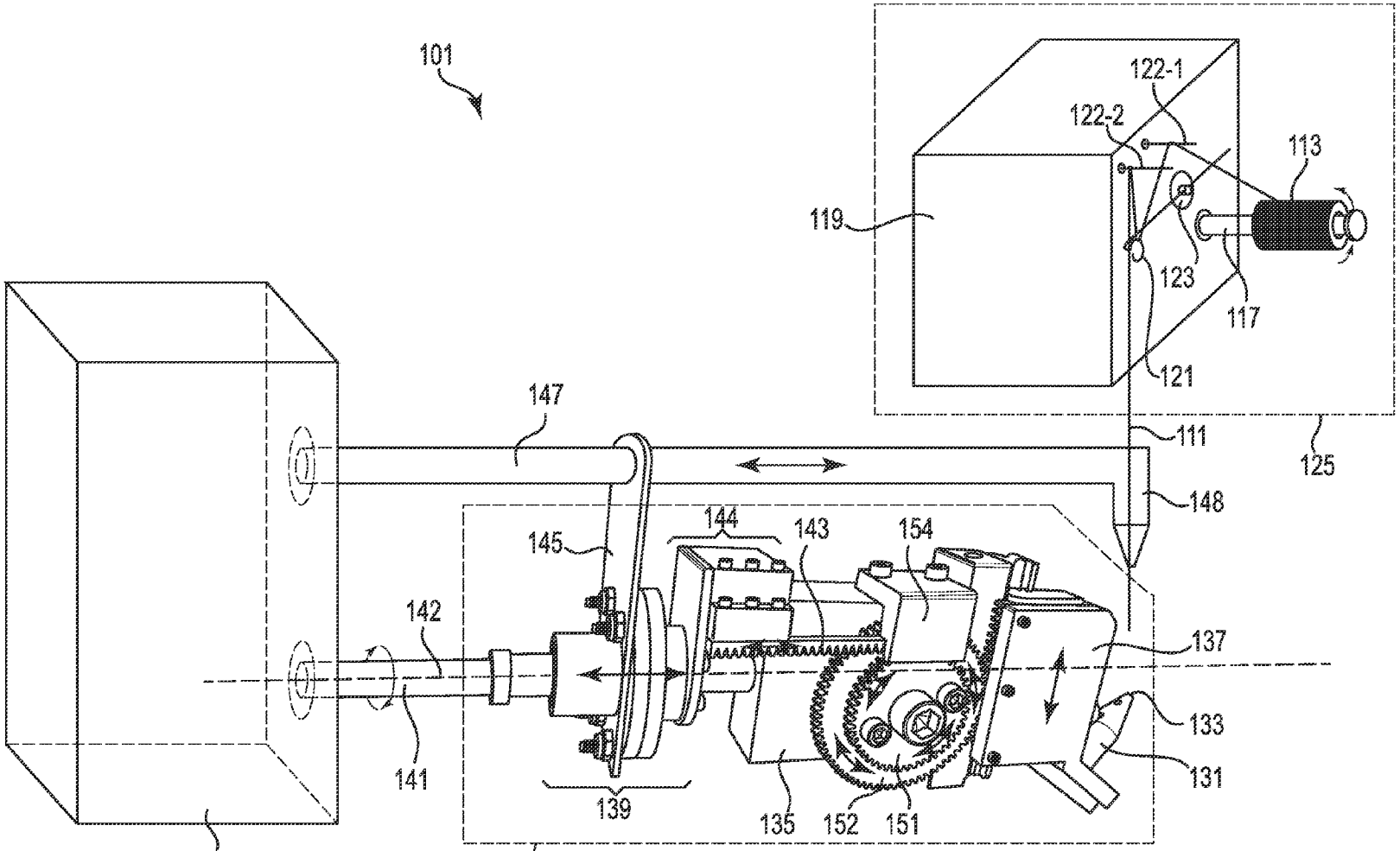
FIG. 1 is an illustration of an example of a system for angular winding according to the present disclosure.

Winding a wire onto an object (e.g., a cylindrical object, a rod, a tube, a mandrel, etc.) at an angle other than perpendicular to a longitudinal axis of the object can be difficult. The tension of the wire at an angle can cause the wire to move sideways along the cylindrical object in an unwanted direction. Winding the wire with a minimized and constant tension on the wire can allow the wire to maintain a location at a winding point along the cylindrical object. The variation in tension can be minimized by maintaining the winding point at a position orthogonally stationary with respect to a longitudinal axis (also known as axis of rotation) of an axle while rotating the axle. Orthogonally stationary can refer to no movement in a plane (e.g., a flat, two-dimensional surface) orthogonal to the longitudinal axis of the axle while rotating the axle. In this way, the wire can be wound at an angle other than perpendicular to the longitudinal axis of the cylindrical object. While in some of the following embodiments described below a wire is wound around a cylindrical object, embodiments are not so limited.

An object including wire wound at an angle can be useful for detection of the object location for medical navigation purposes. As an object with multiple coils wound at an angle moves through a physiological area (e.g. medically navigating a blood vessel, an esophagus, physiological tubing, etc.), the movement of the cylindrical object is detectable in directions that may not be detected by multiple coils wound around an object without angular winding (e.g., wound around an object with the turns perpendicularly to the axis of the coil). Wires wound at different angles can provide additional dimensional information to enable determination of movements and locations of an object that may not be possible with a wire wound at only one angle (e.g., perpendicular to a longitudinal axis of the object). For example, precise movements of a cylindrical object used for medical navigation can include movements perpendicular to a longitudinal axis of the cylindrical object, along the longitudinal axis, and varying degrees of movement therebetween. Winding wire on the cylindrical object at multiple angles can improve the ability to detect smaller degrees of these movements as compared to multiple coils wound at the same angle. Methods for performing such medical navigation can include electromagnetic tracking and/or navigation and electromagnetic sensing and/or sensors for such medical procedures as guiding endoscopic tools and catheters down a pulmonary tract, radiation oncology to guide implantation of radiosurgical markers and/or fiducials, in addition to other medical uses.

In the following detailed description of the present disclosure, reference is made to the accompanying drawings that form a part hereof, and in which is shown by way of illustration how a number of embodiments of the disclosure may be practiced. These embodiments are described in sufficient detail to enable those of ordinary skill in the art to practice the embodiments of this disclosure, and it is to be understood that other embodiments may be utilized and that process, mechanical, and/or structural changes may be made without departing from the scope of the present disclosure. As used herein, "a number of" a particular thing can refer to one or more of such things (e.g., a number of windings can refer to one or more windings).

The figures herein follow a numbering convention in which the first data unit or data units correspond to the drawing figure number and the remaining data units identify an element or component in the drawing. Similar elements or components between different figures may be identified by the use of similar data units. For example, 131 may reference element "31" in FIG. 1, and a similar element may be referenced as 231 in FIG. 2, 331 in FIG. 3, and 431 in FIG. 4. As will be appreciated, elements shown in the various embodiments herein can be added, exchanged, and/or eliminated so as to provide a number of additional embodiments of the present disclosure. In addition, as will be appreciated, the proportion and the relative scale of the elements provided in the figures are intended to illustrate certain embodiments of the present invention, and should not be taken in a limiting sense.

FIG. 1 is an illustration of an example of a system 101 for angular winding according to the present disclosure. In some embodiments, the system 101 can include dereeling components 125, winding components 103, and a winding control unit 149. The winding control unit 149 can be positioned on a flat surface, such as a table, and the dereeling components 125 can include a tension control unit 119 that can be on a flat surface (e.g., a shelf) positioned above the winding control unit 149. In some embodiments, the dereeler can be positioned such that the dereeler and a winding point on the cylindrical object can be maintained at a constant distance apart from each other to hold constant, non-varying tension on the wire while rotating the cylindrical object. The system 101 can wind a wire 111 from a dereeler onto a cylindrical object connected to the winding components 103. The system 101 can use a wire 111 of a number of different gauges and/or lengths. Smaller gauges of wire (e.g., wires with greater diameters) can be rotated around the cylindrical object fewer times to complete a winding of the wire across one longitudinal length of the cylindrical object. Larger gauges of wire (e.g., wires with smaller diameters) can be rotated around the cylindrical object a greater number of times to complete a winding across one longitudinal length of the cylindrical object.

The dereeling components 125 (e.g., dereeler) can be referred to as a "dereeler." However, individual components of the dereeling components 125 (e.g., a combination of the tension control unit 119, the dereeler axle 117, and the spool 113) can also be referred to as a dereeler. In some embodiments, the dereeling components 125 include a wire 111 wound on a spool 113. The spool 113 can be connected to a side of the tension control unit 119. In some embodiments, the spool rotates freely about the dereeler axle 117 and tension on the wire 111 causes the spool 113 to rotate and unwind wire 111 off of the spool 113. In some embodiments, the dereeler axle 117 can rotate the spool 113 to unwind the wire 111 off of the spool 113. The rotation of the dereeler axle 117 and/or the spool 113 can be coordinated with tension on the wire 111 such that the wire 111 winds off of the spool 113 while the wire's tension remains substantially constant and the wire 111 remains taut. In some embodiments, the dereeling control unit 119 can control a speed and direction of rotation of the dereeler axle 117 of the spool 113. In some embodiments, the dereeler axle 117 may not rotate and the spool 113 can rotate about the dereeler axle 117.

In some embodiments, the wire 111 can be wound off of the spool 113 and around a first peg 122-1. The wire 111 can be wound from the first peg 122-1 through a tension arm 121. The position of the tension arm 121 (indicating a tension of the wire) changes as the wire is wound off of the spool 113 and puts pressure on the tension arm 121 to change position. The tension arm 121 can be connected to a rotatable component 123. The rotatable component 123 can be connected to the tension control unit 119 and communicate a tension of the tension arm 121, and thus the wire 111, to the tension control unit 119. The wire 111 can be wound from the tension arm 121 to a second peg 122-2 and around the second peg 122-2 before going through a wire guide 148. In some embodiments, the wire 111 can be dereeled off of the spool 113, through the first peg 122-1, through a tension arm 121, through a second peg 122-2, and through a wire guide 148.

In some embodiments, the tension arm 121 can include a loop, a rod, and a rod holder to receive the rod. The loop of the tension arm 121 can be used to receive the wire through the loop. The rod of the tension arm 121 can be inserted through a rod holder that is rotatable to allow each end of the rod of the tension arm 121 to go up and/or down due to tension from the wire 111. The distance the loop is from the rod holder can affect the amount of tension the tension arm 121 puts on the wire 111. For example, the tension on the wire 111 can change based on how far from the rod holder the loop of the tension arm 121 is located. In addition, the tension of the wire 111 can change based on the weight and balance of the tension arm 121. The tension arm 121 moves up and down to control the dereeling of the wire 111 off the spool 113 via feedback of the tension arm 121 position back to the control unit 119 driving the dereeler axle 117 to allow the wire 111 to be wound onto a cylindrical object at a constant rate and tension.

The wire 111 can go through a wire guide 148 and be wound onto a object (e.g., a rod, a tube, a mandrel, etc.). Although not specifically illustrated, the object can be received, at 133, by an arbor 131 of the winding components 103. As the arbor 131 rotates around a longitudinal axis 142 of a winding axle 141, the wire can be wound onto the object received by the arbor 131. The winding axle 141 can be rotated about a longitudinal axis 142 of the winding axle 141. The longitudinal axis 142 can also be referred to as an axis of rotation of the winding axle 141. The winding components 103 can rotate about the axis of rotation 142. The arbor 131 may not rotate (e.g., spin) about the arbor's 131 longitudinal axis but rather a different longitudinal axis (e.g., longitudinal axis 142). That is, in some embodiments, the axis of rotation (e.g., longitudinal axis 142) of the cylindrical object is non-collinear with the longitudinal axis of the cylindrical object. In some embodiments, the cylindrical object can include a tube that the wire 111 is wound on to. The wire can be wound onto the tube and then removed and placed onto a rod. In this way, the wire can be wound onto any number of cylindrical objects and placed on any number of additional cylindrical objects once the winding is completed.

Figure 2:
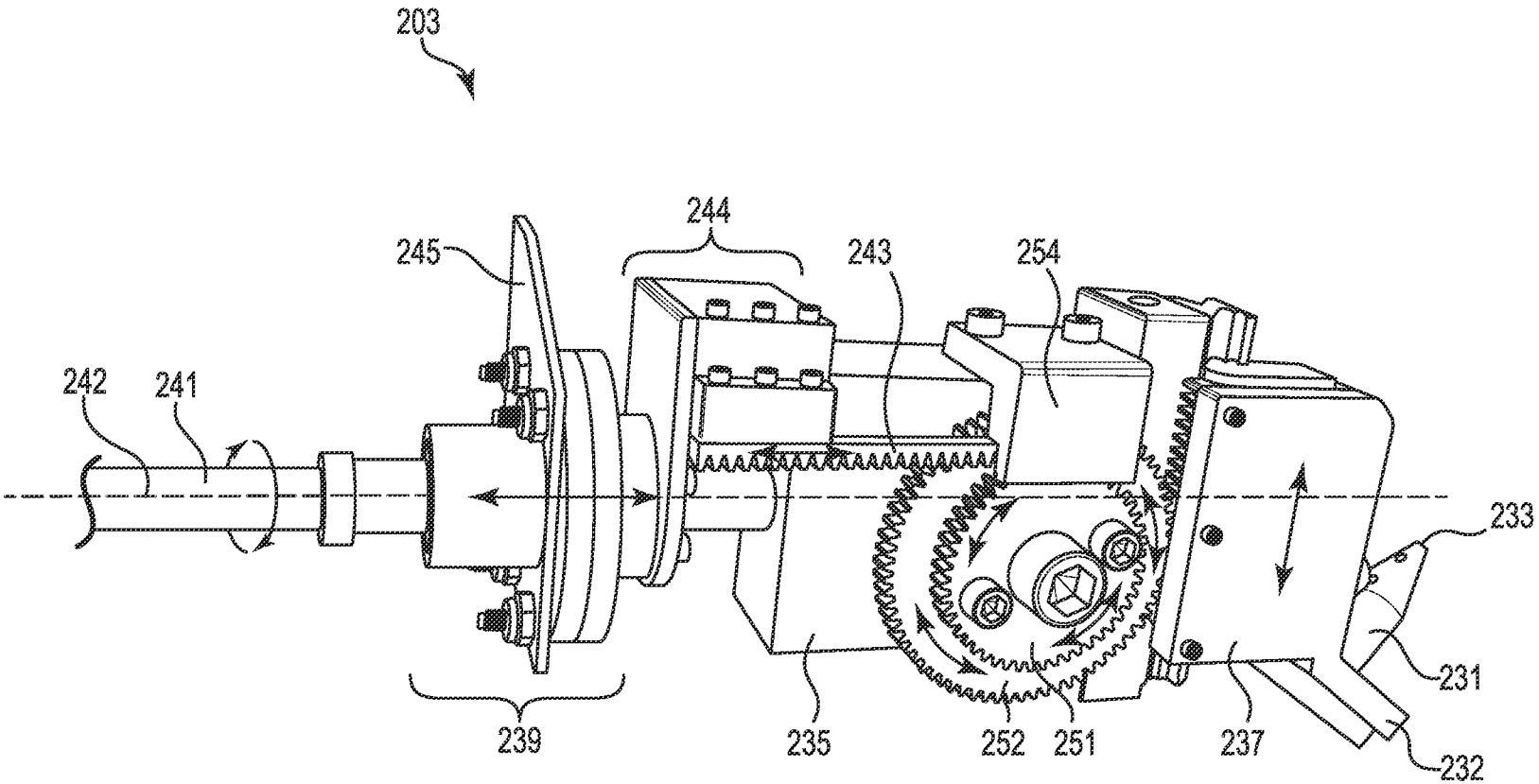
FIG. 2 is an illustration of an example of winding components according to the present disclosure.
Figure 3:
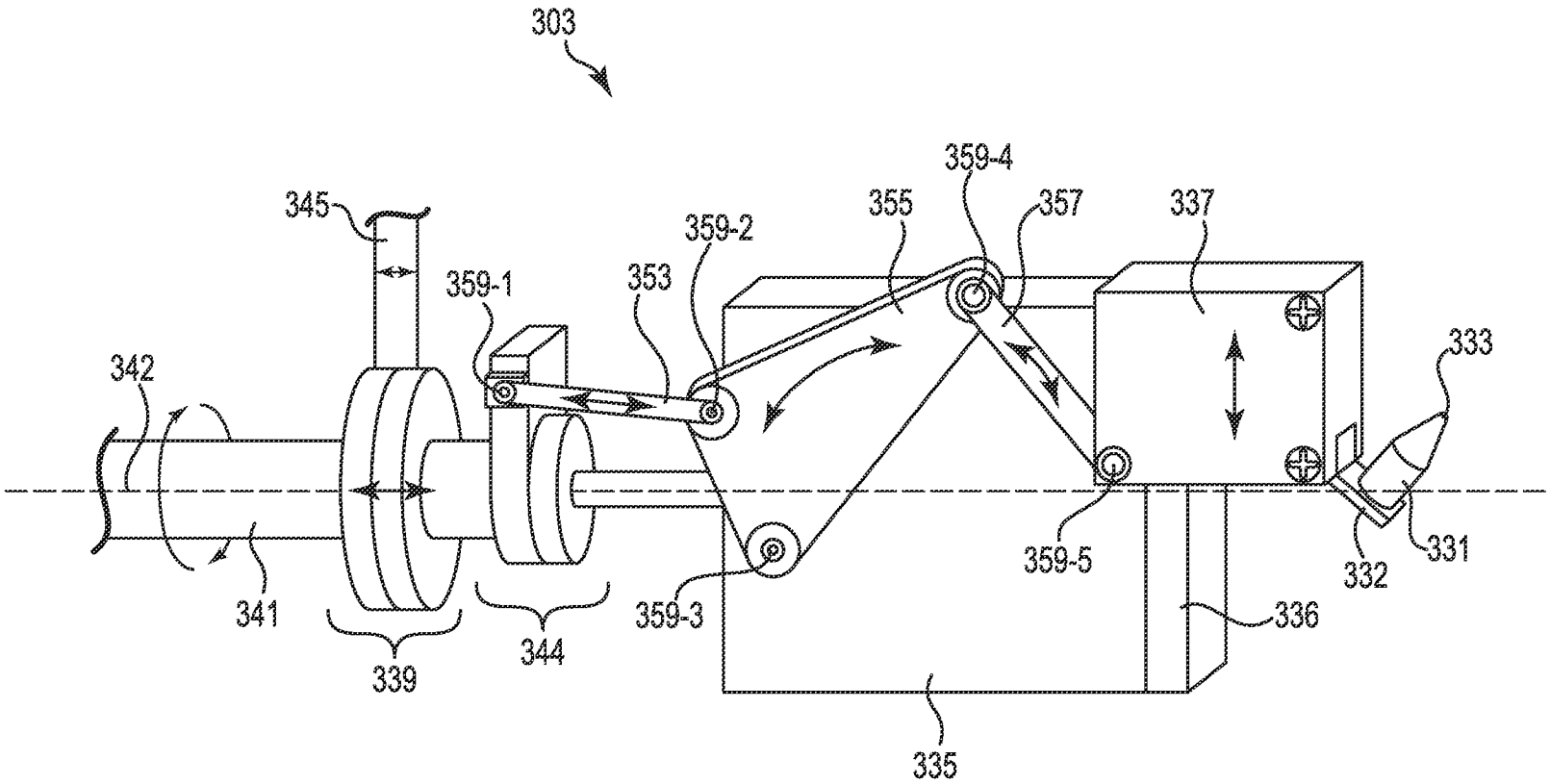
FIG. 3 is an illustration of an example of winding components according to the present disclosure.

The winding components 103 can be implemented as a number of different embodiments for winding. For example, FIG. 2 illustrates an example of an embodiment of winding components (e.g., winding components 103) including teeth of the moveable component 143 (e.g., teeth of moveable component 143 in FIGS. 1 and 243 in FIG. 2 in communication with teeth of cog 151 and 251, respectively) to communicate side-to-side movement during winding. In another example, FIG. 3 illustrates an example of an embodiment including a number of connection components (e.g., connection components 353, 355, and 357) that communicate side-to-side movement during winding. The wire 111 can be wound off of the spool 113 when the winding components 103 are rotated about a winding axle 141.

An arbor 131 can include an axle and/or spindle on which something revolves and/or rotates. The arbor 131 can receive, at 133, the cylindrical object in an opening of the arbor that holds the cylindrical object in place. The cylindrical object can be any object that is capable of insertion into the arbor 131. The arbor 131 can be connected to a first component 135, a second component 137, and a third component 139. In some embodiments, the second component 137 can be directly connected to the arbor 131 and the second component can be directly connected to the first component 135 and the third component 139.

In some embodiments, the first component 135 and second component 137 can be connected to a winding axle 141 such that when the winding axle 141 rotates, the first component 135 and second component 137 also rotate. A first cog 151 and a second cog 152 can be connected to the first component 135. A holding component 154 can be connected to the first component 135 such that teeth of the first cog 151 and the second cog 152 turn within a portion of the holding component 154 (as illustrated in FIG. 1 by arrows). Teeth of a moveable component 143 interact with teeth of the first cog 151 such that when the moveable component 143 moves to either side (as illustrated by arrows in FIG. 1) along the longitudinal axis 142 of the winding axle 141, the first cog 151 rotates. The first cog 151 is connected to the second cog 152 such that when the first cog 151 rotates, the second cog 152 rotates in kind (e.g., with the same angular frequency).

In some embodiments, a translation component 144 is connected to the third component 139 and the moveable component 143 such that the moveable component 144 slides over the first component 135. The translation component 144 is also connected to the third component 139 such that the translation component moves side-to-side, parallel to the longitudinal axis 142 of the winding axle 141, when the third component 139 moves side-to-side. The translation component 144 can also rotate around the longitudinal axis 142 of the winding axle 141 even though the third component 139 does not rotate about the longitudinal axis 141. This is due to the winding axle 141 rotating freely within a collar of the third component 139 which allows the winding axle 141 to rotate without rotating the third component 139. However, the axle is fixedly connected to the first component 135 and therefore the first component 135 rotates with the winding axle 141.

As the third component 139 moves side-to-side, the translation component 144 also moves side-to-side an equal distance. The translation component 144 can slide over the first component 135, allowing the teeth of the moveable component 143 to move side-to-side within the holding component 154. The teeth of the moveable component 143 are interlocked with the teeth of the first cog 151. As the teeth of the moveable component 143 move to the right, the first cog 151 rotates clockwise (and therefore the second cog 152 rotates clockwise). The teeth of the second cog 152 are interlocked with the teeth of the second component 137. Therefore, clockwise rotation of the second cog 152 causes the second component 137 to move downward (e.g., downward in the plane orthogonal to the longitudinal axis 141). This rotation and orthogonal movement translates the side-to-side movement of the third component 139 to the arbor 131 through the first component 135 and the second component 137 (as described further in the discussion of FIG. 2).

In some embodiments, the second component 137 can be moveably connected to the first component 135 such that the second component 137 moves in a direction orthogonal (as illustrated by the arrows in FIG. 1) to the axis of the winding axle 141. The second component 135 can be immovably fixed to the winding axle 141. In some embodiments, the second component 135 and the winding axle 141 are immovable along the longitudinal axis 142 of the winding axle 141. That is, the second component 135 and the winding axle 141 rotate but do not move side-to-side along the longitudinal axis 142 of the winding axle 141. However, embodiments are not so limited. In another embodiment, the winding axle 141 may move along the longitudinal axis 142 of the winding axle 141 and the wire guide 148 would be stationary with respect to side-to-side movement. The second component 137 can be fixed to the first component 135 in relation to side-to-side movement along the longitudinal axis 142 of the winding axle 141 but moveable in relation to the direction orthogonal to the longitudinal axis 142 (again, as illustrated by the arrows in FIG. 1). Movement of the second component 137 in the direction orthogonal to the longitudinal axis 142 of the winding axle 141 causes the arbor 131 to also move in the direction orthogonal to the longitudinal axis 142 of the winding axle 141.

Figure 4A:
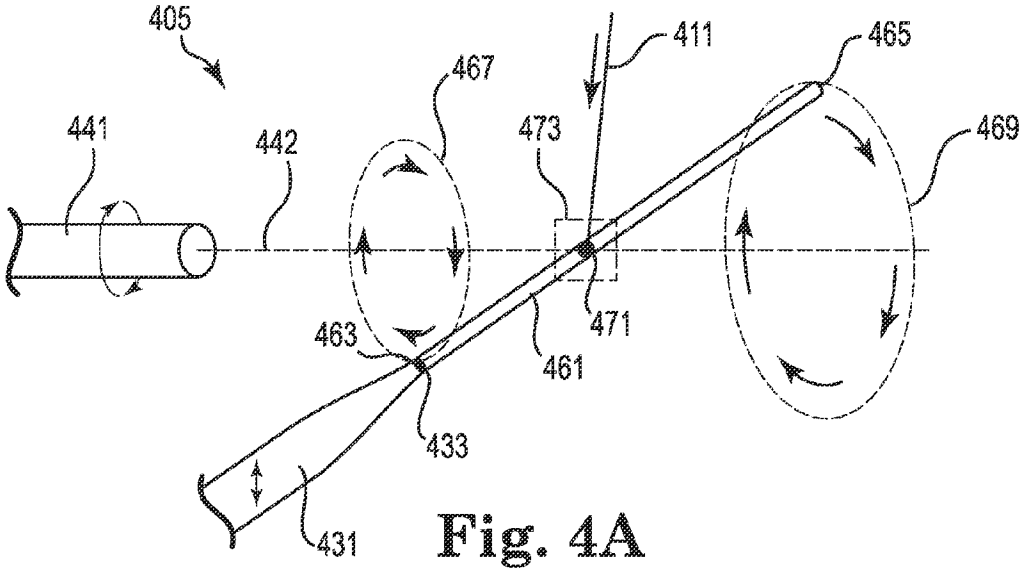
FIG. 4A is an illustration of an example of winding according to the present disclosure.

The second component 137 moves in the direction orthogonal to a longitudinal axis 142 such that a winding point (e.g., winding point 471 illustrated in FIG. 4A) is maintained stationary (further described in discussion of FIG. 4). The first component 135 and the second component 137 may not traverse along the axis of the winding axle 141. The winding axle 141 can rotate freely within the third component 139 so that the third component moves from side to side along the axis of the winding axle 141 but does not rotate about the axis of the winding axle 141. For example, the winding axle 141 can rotate about its axis while the third component 139 moves from side-to-side along the axis of the winding axle 141. In some embodiments, the winding axle 141 can rotate about its axis, but does not translate along its axis.

In some embodiments, the third component 139 can be connected by an extension 145 to a guide axle 147. The guide axle 147 can translate side-to-side about its longitudinal axis as illustrated by the arrows in FIG. 1. As such, translational movement of the third component 139 can be slaved to translational movement of the guide axle 147. The guide axle 147 can be connected to a wire guide 148 such that when the guide axle 147 moves side-to-side, the wire guide 148 also moves side to side. The guide axle 147 can extend from a winding control unit 149. The winding control unit 149 can control the side-to-side traversal of the wire guide 148 by moving the guide axle 147 from side-to-side a particular distance at a particular rate depending on winding factors (e.g., size of the wire, size of the cylindrical object, etc.).

One winding factor is a width of the wire 111. For example, the wire guide 148 can move a larger distance side-to-side over time when winding a wire with a greater width in order to line each coil around the cylindrical object per rotation of the winding axle. The wire guide 148 can move a shorter distance over time when winding a wire 111 onto a cylindrical object with a lesser diameter due to the wire 111 covering a lesser portion of the cylindrical object in one coil around the cylindrical object during one rotation. The movement of the wire guide 148 can be translated through the third component 139, the translation component 144, the moveable component 143, the first cog 151 and the second cog 152, and the second component 137 to the arbor 131. The arbor 131 can move the cylindrical object (e.g., cylindrical object 461 in FIG. 4) such that the cylindrical object moves in a plane orthogonal to the longitudinal axis 142 of the winding axle 141. The cylindrical object can be moved a particular distance per turn of the wire around the cylindrical object based on the width of the wire (as described above in relation to movement of the wire guide 148). The wire 111 can pass through the tip of the wire guide 148 and be guided onto a cylindrical object (not illustrated) received by the arbor 131.

Another winding factor is a width of the cylindrical object. The greater the width of the cylindrical object, the slower the cylindrical object moves along the longitudinal axis 142 of the winding axle 141 to complete one coil of the wire around the cylindrical object. In the alternative, the smaller the width of the cylindrical object, the faster the cylindrical object moves along the longitudinal axis 142 of the winding axle 141 to complete one coil. The above mentioned speeds moving along the longitudinal axis 142 of the winding axle 141 is in relation to a constant speed of rotation.

Another winding factor is a speed of rotation of the winding axle 141. If the speed of rotation is altered, the speeds at which the cylindrical object moves along the longitudinal axis 142 of the winding axle 141 may be affected. For example, a greater rotation speed can cause a speed at which the cylindrical object will move along the longitudinal axis 142 of the winding axle 141 to increase. However, the relative speeds (i.e., faster along the longitudinal axis of the winding axle for smaller width of the cylindrical object and slower for greater width of the cylindrical object, remains the same).

Another winding factor is a desired length along the cylindrical object to wind coils around the cylindrical object. If a cylindrical object is to have wire wound around only half the cylindrical object. A particular speed of rotation and a particular speed of movement of the cylindrical object along the longitudinal axis 142 of the winding axle 141 can be altered based on a desired time to complete the winding of the coils around the wire. For example, at a particular wire width and cylindrical object diameter, the wire can be wound around half the length of the cylindrical object. At the particular wire width and cylindrical object diameter, the wire can be wound around a fourth of the length of the cylindrical object in half the time with the particular speeds of the rotation and the movement along the longitudinal axis 142 of the winding axle 141.

The winding control unit 149 can be programmed to wind a wire 111 onto a cylindrical object (e.g., a rod, a tube) connected to an arbor 131. The winding control unit 149 can wind the wire 111 onto the cylindrical object on the arbor 131 by rotating the winding axle 141 at a first speed, and moving the wire guide 148 in a particular direction along the longitudinal axis of the winding axle 141 for a particular length and at a second speed associated with the wire's width, a desired distance along the cylindrical object's length, and a particular angle of the winding on the cylindrical object. The particular angle can include an angle that is not perpendicular to an axis of the cylindrical object. For example, the wire can be wound onto a rod at an angle of 30 degrees, 45 degrees, 70 degrees, etc., with respect to the cylindrical object. As used herein, a perpendicular angle to the axis of the cylindrical object would be a 90 degree angle.

The winding control unit 149 can rotate the winding axle 141 at a speed and move the guide axle 147 to the right a particular distance and at a particular speed to wind the wire 111 from left to right in the illustration in FIG. 1 until the wire winds a desired length to the right side of the cylindrical object. The winding control unit 149 can then move the guide axle 147 to the left in order to wind the wire 111 from the right of the cylindrical object a desired length to the left side of the cylindrical object while the winding axle 141 is also caused to rotate. While the winding control unit 149 moves the guide axle 147 from left to right or right to left, the second component 137 and the arbor 131 connected to the second component 137 are moving orthogonal to the longitudinal axis 142. The speed at which the guide axle 147 moves from side-to-side can be set based on a width of the wire 111 so that the speed of the guide axle 147 and the rotation of the winding axle 141 cause the wire to wind around the cylindrical object such that each coil of wire around the cylindrical object from one rotation of the cylindrical object is lined up next to the previous coil around the cylindrical object. In this way, each coil of the wire 111 can be wound next to a previous coil and winding the wire 111 can be completed without gaps between the coils.

In some embodiments, the cylindrical object inserted at 133 into the arbor 131 has adhesive applied to the cylindrical object. For example, the adhesive can be applied along the length of the cylindrical object such that a wire 111 wound onto the cylindrical object adheres to the cylindrical object. As the wire 111 is wound onto the cylindrical object at an angle, the adhesive can help prevent the wire 111 from slipping from side-to-side along the cylindrical object. The adhesive can be applied prior to the winding. The adhesive can include any number of types and consistencies.

In some embodiments, the wire 111 that is wound onto the cylindrical object can include a number of characteristics. For example, the wire 111 can include an adhesive on the wire 111 (e.g., in addition to or instead of an adhesive on the cylindrical object). The adhesive can prevent the wire 111 from slipping along the cylindrical object while being wound. In some embodiments, the adhesive can be applied prior to winding of the wire 111 on the spool 113. In some embodiments, the adhesive can be applied as the wire 111 is wound off of the spool 113 and onto the cylindrical object. For example, the adhesive can be applied to the wire 111 after a portion of wire 111 passes over the second peg 122-2 and before the wire 111 passes through the wire guide 148. However, embodiments of winding the wire are not so limited. The adhesive can be applied to the wire at a number of locations during the winding process.

FIG. 2 is an illustration of an example of winding components 203 according to the present disclosure. In some embodiments, an arbor 231 can be connected to a winding axle 241 by way of a first component 235 and a second component 237. The arbor 231 can be connected to the second component by a platform 232 such that a wire winds at a particular angle on a cylindrical object. For example, the angle at which the arbor 231 is connected to the second component 237 by the platform 232 can determine an angle at which the wire winds onto the cylindrical object. However, embodiments are not so limited. The arbor 231 can be connected to the second component 237 using a number of connection methods.

The arbor 231 can receive, at 233, a cylindrical object (e.g., a rod, a tube). The second component 237, connected directly to the arbor 231, can be moveable along the first component 235 (as illustrated by arrows in FIG. 2) in a direction orthogonal to a longitudinal axis 242 of the winding axle 241. The longitudinal axis 242 can also be referred to as an axis of rotation as the winding axle 241 rotates about this axis or rotation. The movement of the second component 237 along the first component 235 can be facilitated by teeth along the edge of the second component 237 interlocked with teeth of a second cog 252 connected to a first cog 251. As the second cog 252 rotates, the teeth of the second cog 252 cause the teeth of the second component 237 to move the second component 237 in a plane orthogonal to the longitudinal axis 242 of the winding axle 241. That is, movement of the third component 239 (e.g., movement of wire guide 148 connected to the third component 139 in FIG. 1) can be translated to the second component 237 to cause the second component 237 to move in along a plane orthogonal to the longitudinal axis 242. The first cog 251 and second cog 252 can be connected to the first component 235 such that the first cog 251 and second cog 252 are fixedly connected to rotate together. The first component 235 can be connected to the winding axle 241. The first component 235 and the second component 237 can be immovable along the longitudinal axis 242 of the winding axle 241. The first component 235 and the second component 237 can be connected to the axle 241 such that when the axle 241 rotates, the first component 235 and the second component 237 rotate.

In some embodiments, a third component 239 can be rotatably connected to the winding axle 241 such that the winding axle 241 can rotate within the third component without the third component 239 rotating. The third component can be fixedly connected to a translation component 244 that moves side-to-side, along the longitudinal axis 242 of the winding axle 241, when the third component 239 moves side-to-side. The translation component 244 rotates around the longitudinal axis 242 of the winding axle 241 when the winding axle 241 rotates. While the third component 239 does not rotate when the winding axle 241 rotates, the translation component 244 does rotate when the winding axle 241 rotates. In some embodiments, the translation component 244 is connected to the moveable component 243. Movement of the translation component 244 moves the moveable component 243 and rotates the first cog 251, which in turn rotates the second cog 252. The moveable component 243 includes teeth. The teeth of the moveable component 243 can be in communication with teeth of the first cog 251. The teeth of the moveable component 243 can be held in place on the teeth of the first cog 251 by a holding component 254. The moveable component 243 can move side-to-side parallel to the longitudinal axis 242 of the winding axle 241 when the third components moves side-to-side (as illustrated by the arrows in FIG. 2) along the longitudinal axis 242 of the winding axle 241. In this way, the moveable component 243 communicates side-to-side movement of the third component 239 along the longitudinal axis 242 of the winding axle 241. The third component 239 can be fixedly connected to an axle (e.g., guide axle 147 in FIG. 1) and a wire guide (e.g., wire guide 148 in FIG. 1) connected to the axle. As the wire guide moves side-to-side with respect to the longitudinal axis 242 of the winding axle 241, the third component 239 connected to the wire guide also moves side-to-side.

As the third component 239 moves side-to-side, the side-to-side movement is communicated through the translation component 244 and the moveable component 243 through interaction of the teeth of the moveable component 243 with the teeth of the first cog 251 to rotate the first cog 251 and therefore also to rotate the second cog 252, which by interaction of the teeth of the second cog 252 with the teeth of the second component 237, causes the second component 237 to move orthogonal to the longitudinal axis 242 of the winding axle 241.

The teeth of the moveable component 243, the first cog 251, the second cog 252, and the second component 237 can be spaced such that a winding point (e.g., winding point 471 in FIG. 4A) of a cylindrical object received by the arbor 231 is maintained at a particular position (as described in FIG. 4). The teeth of the moveable component 243, the first cog 251 and second cog 252, and the second component 237 can be adjusted to accommodate a wire to wind at a particular angle on a cylindrical object. While an angle at which the arbor 231 is connected to the second component 237 determines a particular angle at which the wire winds onto the cylindrical object, other components (e.g., teeth on cogs 251 and 252, and moveable component 243) may need to be adjusted. For example, the teeth can be spaced a first distance apart so that the second component 237 moves orthogonal a second distance when the third component 239 moves a third distance (and therefore a wire guide connected to the third component 239 moves the third distance from side-to-side as well) from side-to-side along the longitudinal axis 242 of the winding axle 241 to wind the wire at a first angle (e.g., 45 degrees). In another example, the teeth can be spaced a fourth distance apart so that the second component moves orthogonal a fifth distance when the third component 239 moves a sixth distance to wind the wire at a second angle (e.g., 30 degrees). A number of degrees for winding the wire onto a cylindrical object can be achieved by adjusting the spacing of the teeth to accommodate the number of degrees. In some embodiments, a gear ratio (e.g., of cogs 251 and 251) can be adjusted when the particular angle at which the wire winds onto the cylindrical object is changed and/or adjusted. For example, a diameter of the first cog 251 and the second cog 252 can be adjusted such that when the third component 239 moves to the right (as illustrated by arrows in FIG. 2), the first cog 251 and the second cog 252 can rotate at a different rate to cause the second component 237 to move in the plane orthogonal to the longitudinal axis 242 at an additional different rate. These adjustments of the gear ratios and/or space between teeth are implemented to maintain a winding point, as described further below in FIG. 4.

FIG. 3 is an illustration of an example of winding components 303 according to the present disclosure. A first component 335 can be fixedly connected to a winding axle 341 such that rotation of the winding axle 341 about its longitudinal axis 342 (as indicated by the arrows in FIG. 3) causes rotation of the first component 335. This longitudinal axis 342 can also be referred to as an axis of rotation as the winding axle 341 and additional components (e.g., second component 337, first component 335, among others) rotate about this longitudinal axis 342. A second component 337 can be slidably connected to the first component 335 such that the second component 337 is moveable in a direction orthogonal to the longitudinal axis 342 of the winding axle 341 along the first component 335 (as indicated by the arrows in FIG. 3). For example, the second component 337 can be slidably connected to a track component 336 that is fixedly connected to the first component 335. The second component 337 can be connected to an arbor 331. The arbor 331 can receive, at 333, a cylindrical object (e.g., a rod, a tube, a mandrel, etc.). The first component 335 and the second component 337 can be immovable along the longitudinal axis 342 of the winding axle 341.

In some embodiments, a third component 339 can be connected to a wire guide (e.g., wire guide 148 in FIG. 1). The third component 339 can communicate side-to-side movement of the third component 339 (and therefore the wire guide) along the longitudinal axis 342 (as illustrated by arrows in FIG. 3) through a first connection component 353, a second connection component 357, and a third connection component 357. The third component 339 can be connected to a translation component 344 that translates side-to-side movement along the longitudinal axis 342 of the third component 339. The third component can be connected to the translation component 344 such that when the third component 339 moves side-to-side, the translation component 344 moves side-to-side. However, the translation component 344 rotates around the longitudinal axis 342 of the winding axle 341 when the winding axle 341 rotates even though the third component 339 does not rotate around the longitudinal axis 342. In some embodiments, the translation component 344 is connected the first connection component 353 at a first pivot point 359-1. The first pivot point 359-1 can be rotatably connected to the translation component 344. The first connection component 353 can be connected to the second connection component 355 at a second pivot point 359-2. The second connection component 355 can be connected to the first component 335 at a third pivot point 359-3. The third pivot point 359-3 can be rotatably connected to the first component 335 such that a second connection component 355 rotates around the third pivot point 355. The second connection component 355 can be connected to the third connection component 357 at a fourth pivot point 359-4. The third connection component 357 can be connected to the second component 337 at a fifth pivot point 359-5. Movement of the third component 339 from side-to-side along the longitudinal axis 342 of the winding axle 341 can cause the translation component 344 to move along the longitudinal axis 342 as well. Movement of the translation component 344 causes the first connection component 353 to move as well (as illustrated by arrows in FIG. 3).

Movement of the first connection component 353 can cause movement of second connection component 355 and the third connection component 357 (as illustrated by arrows in FIG. 3). The angle at which the first, second, and third connection components 353, 355, and 357 are connected can be determined by lengths of the first connection component 353, the second connection component 355, and the third connection component 357, in addition to the position of the winding mechanism 303. For example, as the third component 339 moves to the right (in the example in FIG. 3), the first connection component 353, the second connection component 355, and the third connection component 357 move to the right. The first pivot point 359-1 moves to the right, the second pivot point 359-2 moves upward and to the right, the third pivot point 359-3 allows the second connection component 355 to rotate clockwise, the fourth pivot point 359-4 moves to the right and downward, and the second component 337 moves downward. This movement is based on predetermined angles and lengths that result in the second component moving downward a particular distance when the third component 339 moves right along the longitudinal axis 342 of the winding axle 341. If the angle of the arbor 331 in relation to the second component 337 is modified, the lengths of the first connection component 353, the second connection component 355, and the third connection component 357 would need to be modified to change the angles at which each piece is connected to cause the arbor 331 to move to maintain a winding point (e.g., winding point 471 described in FIGS. 4A and 4B).

As the wire guide connected to the third component 339 moves to the right to move the wire (e.g., wire 111 in FIG. 1) to the right along the cylindrical object, the third component 339 moves an equal distance to the right. As an example, movement of the third component 339 to the right causes the first connection component 353 to move to the right. Movement of the first connection component 353 causes the second pivot point 359-2 to move in an upward and rightward direction with respect to the orientation of the winding components 303 illustrated in FIG. 3. As will be appreciated, the description of these relative directions would change as the winding components 303 rotate about the winding axle 341. The second pivot point 359-2 moving in an upward and rightward direction causes the fourth pivot point 359-4 to move rightward and downward. The rightward and downward movement of the fourth pivot point 359-4 causes the third connection component 357 to move downward and rightward. The downward and rightward movement of the third connection component 357 causes the second component 337 to move in a downward direction orthogonal to the longitudinal axis 342 of the winding axle 341 along the track component 336. As an example, when the wire guide and the third component 339 move to the left, the second component 337 moves in an upward direction along the track component 336. The first connection component 353, the second connection component 355, and the third connection component 357 can be adjusted to cause the second component 337 to move orthogonal to the longitudinal axis 342 of the winding axle 341 at a particular rate and distance correlating to the side-to-side movement of the third component 339 along a longitudinal axis 342 to wind a wire onto a cylindrical object at a particular angle.

FIG. 4A is an illustration of an example of winding according to the present disclosure. The wire 411, the arbor 431, and the winding axle 441 are analogous to the wire 111, the arbor 131, and the winding axle 141 illustrated in FIG. 1. The wire 411 can be wound onto a cylindrical object 461. The cylindrical object 461 (e.g., a rod, a tube) can include a proximal end 463 closest to an arbor 431. The cylindrical object 461 can include a distal end 465 furthest from the arbor 431. The arbor 431 can have an opening 433 to receive the cylindrical object 461 and hold the cylindrical object 461 while winding the wire 411 onto the cylindrical object 461. While the cylindrical object 461 is rotated by a winding axle 441 (not directly connected to the cylindrical object but illustrated for reference to a longitudinal axis 442 of the winding axle 441). Rotation of the winding axle 441 can cause rotation of the cylindrical object 461 about the longitudinal axis 442 of the winding axle 441. For this reason, the longitudinal axis 442 can also be referred to as an axis of rotation. The rotation of the cylindrical object 461 can cause the wire 411 to wind onto the cylindrical object 461 from a dereeler (e.g., dereeler 125 as illustrated in FIG. 1).

Figure 4B:
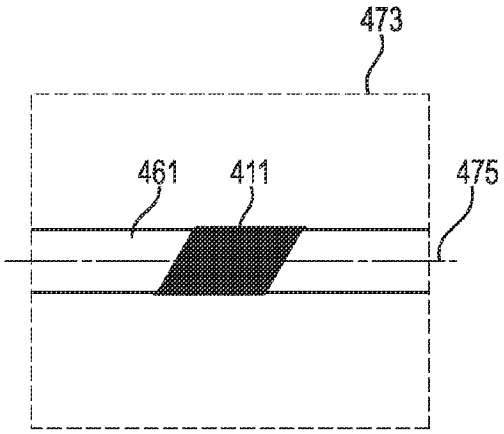
FIG. 4B is an illustration of a portion of the winding of FIG. 4A in more detail.

While the cylindrical object 461 is rotating, the proximal end 463 of the cylindrical object 461 can rotate such that the proximal end 463 traces a shape of a proximal oval 467 (as illustrated by arrows in FIG. 4). While the cylindrical object 461 is rotating, the distal end 465 of the cylindrical object 461 can rotate such that the distal end 465 traces a shape of a distal oval 469 (as illustrated by arrows in FIG. 4). The rotation of the proximal end 463 and distal end 465 in the shape of proximal oval 467 and distal oval 469, respectively, can create a winding point 471 at which the wire 411 winds onto the cylindrical object 461. An illustrated example of the wire wound on the cylindrical object at an angle 473 is further described with respect to FIG. 4B.

The size of the proximal oval 467 can vary based on a location of the winding point 471 along the length of the cylindrical object 461. For example, when the winding point 471 moves toward the proximal end 463, the proximal oval 467 will decrease in diameter, meaning the proximal end 463 will trace a smaller path. As the winding point 471 moves toward the proximal end 463, the distal oval 469 will increase in diameter and the distal end 465 will trace a larger path. In contrast, the distal oval 469 will decrease in diameter and the distal end 465 will trace a smaller path when the winding point 471 moves toward the distal end 465. Likewise, the proximal oval 467 will increase in diameter and the proximal end 463 will trace a larger path as the winding point 471 moves toward the distal end 465.

The winding point 471 can be maintained such that the winding point does not move in a plane orthogonal to the longitudinal axis 442 of the winding axle 441. For example, as a wire guide (e.g., guide axle 147 in FIG. 1) traverses from side-to-side parallel to the longitudinal axis 442 of the winding axle 441, a second component (e.g., second component 137 in FIG. 1) moves in the plane orthogonal to the longitudinal axis 442. The second component (e.g., second component 137 in FIG. 1) is rotating during winding and therefore As the second component moves in the plane orthogonal to the longitudinal axis 442, arbor 431 holds the cylindrical object 461 such that the winding point 471 does not move in a plane orthogonal to the longitudinal axis 442, but rather maintains a position along the longitudinal axis 442. The winding point 471 remains orthogonally stationary with respect to the longitudinal axis 442. That is, the winding point 471 does not move in a plane orthogonal to the longitudinal axis 442. The arbor 431 is not orthogonally stationary as the arbor 431 moves in an orthogonal direction in relation to (e.g., in a plane orthogonal to) the longitudinal axis 442. As the arbor 431 is moved in a direction orthogonal to the longitudinal axis 442 (as indicated by the arrows in FIG. 4A), for example, by its connection to a second component such as second component 137 in FIG. 1, the winding point 471 moves along the cylindrical object 461 either closer to the proximal end 463 or closer to the distal end 465, in order to maintain the position of the winding point 471 along the longitudinal axis 442. The cylindrical object 461, by its connection to the arbor 431, moves in a plane orthogonal to the longitudinal axis 442. For example, as the arbor 431 moves away from the longitudinal axis 442 along a plane orthogonal to the longitudinal axis 442 while rotating, the distal end 465 moves closer to the longitudinal axis 442 while the proximal end 463 moves further away from the longitudinal axis 442. In the reverse, as the arbor 431 moves toward the longitudinal axis 442 along the plane orthogonal to the longitudinal axis 442 while rotating, the distal end 465 moves further away from the longitudinal axis 442 while the proximal end 463 moves closer to the longitudinal axis 442.

Because the position of the winding point 471 is maintained along the longitudinal axis 442 while the wire guide (e.g., guide axle 147 in FIG. 1) moves the wire 411 along the longitudinal axis 442 of the winding axle 441, the wire 411 experiences a constant tension and is less likely to slip a variable amount along the cylindrical object 461. For example, if the winding point moved toward a dereeler in a direction orthogonal (e.g., in an upward direction in FIG. 1 toward dereeler 125) to the longitudinal axis 442, then the tension of the wire 411 would be lessened and would reduce slipage along the cylindrical object 461. In contrast, if the winding point moved away from a dereeler in an orthogonal direction to the longitudinal axis (e.g., in a downward direction in FIG. 1 away from dereeler 125), the tension on the wire 411 would increase and the winding of the wire 411 could be affected. By controlling the position at which the wire 411 winds onto the cylindrical object 461, the wire 411 has an increased ability to wind without slipping or with a constant slippage amount and without affecting the accuracy of the placement of the wire 411 while winding.

FIG. 4B is an illustration 473 of a portion of the winding of FIG. 4A in more detail. In some embodiments, a wire 411 can be wound around a cylindrical object 461 at an angle that is not perpendicular to an axis 475 of the cylindrical object 461. For example, a wire 411 can be wound at a number of angles (e.g., 45 degrees, 60 degrees, 30 degrees, etc.) that do not include a 90 degree angle with a longitudinal axis 475 of a cylindrical object 461. Each coil of the wire around the cylindrical object 461, due to a single rotation of the longitudinal axis 441, can be wound next to a previous coil (as illustrated in FIG. 4B). For example, a first rotation can wind the wire 411 around the cylindrical object 461 once for a first coil. A second rotation of the longitudinal axis 441 can wind the wire 411 around the cylindrical object to place a second coil of the wire around the cylindrical object 461 right next to the first coil. The wire can be wound around the cylindrical object 461 so that there is no space between the first coil and the second coil (e.g., without a space between each turn of the wire). This process can be repeated to wind the wire around the cylindrical object such that there are no spaces (e.g., gaps) from coil to coil along the cylindrical object 461 (as illustrated in FIG. 4B).

The wire 411 can be wound at this non-perpendicular angle due to a winding point (e.g., winding point 471 in FIG. 4A) being maintained such that orthogonal movement of the winding point, with respect to the longitudinal axis, is minimized. The minimization of the orthogonal movement reduces tension variation on the wire while the cylindrical object is rotating about an axis other than the longitudinal axis of the cylindrical object (e.g., a rotation of the cylindrical object such that the ends of the cylindrical object, e.g., proximal and distal ends 463 and 465, trace ovals such as proximal oval 467 and distal oval 469). The winding of the wire at a non-perpendicular angle can be due to the minimization of the orthogonal movement of the winding point. The winding of the wire at a non-perpendicular angel can be due to adhesive added to the wire. The combination of the minimization of the orthogonal movement of the winding point and the adhesive on the wire can benefit the winding of the wire at a non-perpendicular angle.

In some embodiments, a wire can be wound onto a cylindrical object (e.g., a rod) at an angle that is not perpendicular to a longitudinal axis of an axle. In some embodiments, a wire can be wound onto a cylindrical object (e.g., a tube) at a non-perpendicular angle. The angled wire can be transferred from the tube and onto a rod. That is, a wire can be wound onto a number of cylindrical objects (e.g., a tube, a mandrel, etc.) and be transferred from any of the number of cylindrical objects and onto a different cylindrical object (e.g., a rod).

Although specific embodiments have been illustrated and described herein, those of ordinary skill in the art will appreciate that an arrangement calculated to achieve the same results can be substituted for the specific embodiments shown. This disclosure is intended to cover adaptations or variations of a number of embodiments of the present disclosure. It is to be understood that the above description has been made in an illustrative fashion, and not a restrictive one. Combination of the above embodiments, and other embodiments not specifically described herein will be apparent to those of skill in the art upon reviewing the above description. The scope of the number of embodiments of the present disclosure includes other applications in which the above structures and methods are used. Therefore, the scope of a number of embodiments of the present disclosure should be determined with reference to the appended claims, along with the full range of equivalents to which such claims are entitled.

In the foregoing Detailed Description, some features are grouped together in a single embodiment for the purpose of streamlining the disclosure. This method of disclosure is not to be interpreted as reflecting an intention that the disclosed embodiments of the present disclosure have to use more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A method for winding, comprising:

dereeling a wire from a dereeler onto an object; and rotating the object to wind the wire on the object at an angle offset from perpendicular to a longitudinal axis of the object, wherein an axis of rotation of the object is non-collinear with the longitudinal axis of the object, and wherein a winding point on the object remains orthogonally stationary with respect to the axis of rotation.

2. The method of claim 1, wherein the method includes applying an adhesive to the object prior to the dereeling.

3. The method of claim 1, wherein the method includes applying an adhesive to the wire during the winding.

4. The method of claim 1, wherein the method includes applying an adhesive to the wire prior to the dereeling.

5. The method of claim 1, wherein the method includes moving the object in a direction orthogonal to the axis of rotation during the winding.

6. The method of claim 1, wherein rotating the object includes rotating the object such that a first end of the object traces a first ellipse and a second end of the object traces a second ellipse.

7. The method of claim 6, wherein rotating the object includes rotating the object such that the winding point on the object remains stationary in a plane parallel to the first ellipse.

8. A method for winding, comprising:

dereeling a wire from a dereeler to an cylindrical object that has adhesive applied thereto; and moving the cylindrical object to wind the wire from the dereeler onto the cylindrical object at an angle offset from perpendicular to a longitudinal axis of the cylindrical object, wherein the adhesive holds the wire at the angle along the longitudinal axis of the cylindrical object.

9. The method of claim 8, wherein moving the cylindrical object includes moving the cylindrical object in a plane orthogonal to an axis of rotation of the cylindrical object during the winding to wind the wire along a portion of the cylindrical object in a direction of the longitudinal axis.

10. The method of claim 9, wherein moving the cylindrical object in the plane includes moving the cylindrical object in the plane at a rate to wind the wire from a distal end to a proximal end of the cylindrical object without space between each turn of the wire around the cylindrical object.

11. The method of claim 10, wherein moving the cylindrical object in the plane includes moving a particular distance per turn of the wire around the cylindrical object based on a width of the wire.

12. The method of claim 8, wherein moving the cylindrical object comprises rotating the cylindrical object; and wherein the method includes maintaining the dereeler and a winding point on the cylindrical object at a distance apart from each other to hold tension on the wire while rotating the cylindrical object.

13. A winding system, comprising:

an axle;

a first component connected to the axle such that rotating of the axle about a longitudinal axis of the axle causes the first component to rotate, wherein the axle and the first component are immovable along the longitudinal axis; and a second component connected to the first component such that rotation of the first component about the longitudinal axis causes the second component to rotate about the longitudinal axis, wherein the second component is configured to receive an object at an angle offset from the longitudinal axis of the axle; and a third component that translates movement of the third component along the longitudinal axis to the second component, wherein the translated movement causes the second component to move in a plane orthogonal to the longitudinal axis and the movement of the second component causes a winding point on the object to remain stationary in the plane orthogonal to the longitudinal axis.

14. The winding system of claim 13, wherein the second component is configured to receive the object such that the object rotates about an axis different than a longitudinal axis of the arbor when the axle rotates about the longitudinal axis of the axle.

15. The winding system of claim 13, wherein the winding system includes a control unit that controls a speed and direction of rotation of the axle about the longitudinal axis of the axle and a speed and direction of traversal of the third component along the longitudinal axis of the axle.

16. The winding system of claim 13, wherein the winding system includes a dereeler that is configured to dereel a wire onto the object.

17. The winding system of claim 16, wherein the second component is configured to receive the object such that the dereeler winds the wire onto the object at the winding point.

18. The winding system of claim 17, wherein the second component is configured to receive the object such that the wire from the dereeler winds onto the object at a particular angle that is not perpendicular to the longitudinal axis of the received object.

19. The winding system of claim 13, wherein the connection of the second component to the first component is configured such that, while the second component moves in the plane orthogonal to the longitudinal axis, the winding point remains stationary in the orthogonal plane as a wire is wound around the object connected to the second component.

20. The winding system of claim 19, wherein the second component is connected to the first component fixedly with respect to movement in a direction along the longitudinal axis and slidably in the plane orthogonal to the longitudinal axis.

* * * * *